US010609976B2

(12) United States Patent
Zhao

(10) Patent No.: US 10,609,976 B2
(45) Date of Patent: Apr. 7, 2020

(54) QUICK WEARING TOOL FOR MAGNETIC EYELASHES

(71) Applicant: Shenzhen Qianhai Magwow Technology Co., Ltd, Shenzhen, Guangdong (CN)

(72) Inventor: Liwen Zhao, Dongguan (CN)

( * ) Notice: Subject to any disclaimer, the term of this patent is extended or adjusted under 35 U.S.C. 154(b) by 204 days.

(21) Appl. No.: 15/782,736

(22) Filed: Oct. 12, 2017

(65) Prior Publication Data

US 2018/0235298 A1 Aug. 23, 2018

(30) Foreign Application Priority Data

Feb. 23, 2017 (CN) ..... 2017 1 0098228

(51) Int. Cl.
*A45D 40/30* (2006.01)
*A41G 5/02* (2006.01)
*A45D 2/48* (2006.01)

(52) U.S. Cl.
CPC . *A41G 5/02* (2013.01); *A45D 2/48* (2013.01)

(58) Field of Classification Search
CPC . A41G 5/02; A45D 2/48; A45D 26/00; A45D 26/0066
See application file for complete search history.

(56) References Cited

U.S. PATENT DOCUMENTS 1,960,687 A * 5/1934 Wills ..... A41G 5/02 606/205
2,094,409 A * 9/1937 Phillips, Sr. ..... A41G 5/02 132/53
3,516,422 A * 6/1970 Bechtold ..... A41G 5/02 132/53
6,230,715 B1 * 5/2001 Cho ..... A45D 2/48 132/216
9,913,506 B2 * 3/2018 Hansen ..... A41G 5/02
2009/0217939 A1 * 9/2009 Rabe ..... A41G 5/02 132/218
2009/0223534 A1 * 9/2009 Green ..... A41G 5/02 132/216
2014/0216489 A1 * 8/2014 Knaus ..... A45D 40/26 132/200
2016/0206031 A1 * 7/2016 Stoka ..... A41G 5/02
2018/0228237 A1 * 8/2018 Zhang ..... H01F 7/0252
2019/0246729 A1 * 8/2019 Nicoline ..... A41G 5/02
2019/0254373 A1 * 8/2019 Kim ..... A41G 5/02

* cited by examiner

*Primary Examiner* — Nicholas D Lucchesi
(74) *Attorney, Agent, or Firm* — Novoclaims Patent Services LLC; Mei Lin Wong

(57) ABSTRACT

A quick wearing tool for a pair of magnetic eyelashes members, which includes a handle, a clip unit, an upper clip plate connected to a top end of the clip unit; and a lower clip plate moveable connected to the handle allowing upward and downward movement. The two clip plates have a magnetic polarity opposite to the magnetic eyelashes members, are made of iron materials or magnetic materials for forming a magnetic loop with the magnetic eyelashes members. The magnetic properties of the two clip plates are lower than that of the magnetic eyelashes members, therefore the magnetic eyelashes members are pre-loaded onto the two clip plates through magnetic attraction and then detached from the two clip plates to secure into position on real eyelashes by attraction between the two eyelashes members when the lower clip plate is moved upward towards the upper clip plate.

19 Claims, 8 Drawing Sheets

QUICK WEARING TOOL FOR MAGNETIC EYELASHES

BACKGROUND OF THE PRESENT INVENTION

Field of Invention

The present invention relates to a wearing tool for eyelashes and, more particularly to a quick wearing tool for magnetic eyelashes which is simple to use and provides quick application for magnetic eyelashes.

Description of Related Arts

At present, among the eye cosmetics used by women, false eyelashes are widely favored by women because false eyelashes can make the eyelashes more slender, three-dimensional and aesthetically pleasing. The traditional false eyelashes are wore through the connecting portions of the two pieces of false eyelashes respectively in which the connecting portions are coated with adhesive and are pasted onto a human eyelids. This type of false eyelashes can only be used once and the adhesive is not easy to remove from the eyelids. As a result, magnetic false eyelashes are developed. This type of magnetic false eyelashes includes a magnet block provided at the center of the strip-shaped eyelashes carrier. The false eyelashes are attracted to both sides of real eyelashes through the attraction force of the two false eyelashes carriers with opposite magnetic poles. When wearing this type of magnetic false eyelashes, the two pieces of false eyelashes have to be positioned at two sides of the real eyelashes manually in order to allow them to attract to each other, which is a time consuming and laborious wearing process. On the other hands, when wearing the false eyelashes, people will use eyelash curler which includes a fixed upper plate and a movable lower plate to bend the false eyelashes such that the false eyelashes are curved and more aesthetically pleasing. However, traditional eyelash curler is made of non-magnetic metal materials such as stainless steel and it does not have the function of loading magnetic false eyelashes.

SUMMARY OF THE PRESENT INVENTION

An object of the present invention is to solve the above problems and provide a quick wearing tool for magnetic eyelashes which is capable of loading the magnetic false eyelashes to the two sides of the real eyelashes quickly, conveniently and precisely while the magnetic false eyelashes are bent at the same time.

Additional advantages and features of the invention will become apparent from the description which follows, and may be realized by means of the instrumentalities and combinations particular point out in the appended claims.

According to the present invention, the foregoing and other objects and advantages are attained by a quick wearing tool for a magnetic eyelashes unit which comprises an upper magnetic eyelashes member and a lower magnetic eyelashes member, comprising:

a handle; a clip unit integrally provided at a top end of the handle; an upper clip plate connected to a top end of the clip unit; and a lower clip plate moveable connected to the handle in such a manner that the lower clip plate is capable of moving upwardly and downwardly; wherein the upper clip plate and the lower clip plate are having a magnetic polarity opposite to the magnetic eyelashes members respectively or are arranged to form a magnetic loop with the magnetic eyelashes members while the magnetic properties of the upper clip plate and the lower clip plate are lower than that of the magnetic eyelashes members such that the magnetic eyelashes members are capable of loading onto the upper clip plate and the lower clip plate respectively through magnetic attraction and then the magnetic eyelashes members are detached from the upper clip plate and the lower clip plate respectively to secure into position on real eyelashes by attraction between the upper eyelashes member and the lower eyelashes member when the lower clip plate is moved upward towards the upper clip plate, thereby the real eyelashes are sandwiched by the upper eyelashes member and the lower eyelashes member. Preferably, the upper and lower clip plate is made of iron materials or magnetic materials.

The upper clip plate has an arc-shaped sheet-like body corresponding to a shape of an upper eyelid of a human and is made of magnetic or iron materials, wherein all sharp corners of the upper clip plate are flattened into smooth edges.

The upper clip plate is rotatably connected to the clip unit at a top end of the clip unit so that a rotational angle of the upper clip plate is adjustable to fit an angle of loading of magnetic eyelashes unit.

The clip unit has two shaft holes and the upper clip plate has two pivot members integrally extended from two side ends of the upper clip plate, wherein the two pivot members and the two shaft holes are coupled together respectively so that the upper clip plate is moveably connected to the clip unit through the shaft holes.

The clip unit comprises two symmetric side rods and defines a U-shaped structure of the clip unit in which a top open portion are formed through the two side rods while a bottom portion of the two side rods are bended inward to connect together, wherein the bottom portions of the two side rods are connected to the handle.

The lower clip plate comprises a curved clip body which is corresponding to a shape of human eyelid, a flexible stripe having a curved surface on top of the curved clip body, and a conductive adhesive coated onto the surface of the flexible stripe, wherein the conductive adhesive has a magnetic property lower than that of the magnetic eyelashes unit and forms a magnetic loop with the magnetic eyelashes unit, wherein the curved clip body has two ring connection sleeves at two side ends integrally provided on the curved clip body and the two ring connection sleeves are moveable connected to the two side rods of the clip unit such that the curved clip body is capable of sliding upward and downward, wherein the curved clip body is hinged to the handle through the connecting rod.

The upper clip plate has a L-shaped edge portion at a bottom thereof which is outwardly extended from the bottom of the upper clip plate, and has a position corresponding to a position of the flexible stripe, wherein the upper clip plate and the lower clip plate comprise a color indicator at a position corresponding to a position guiding member or magnetic eyelashes unit.

The handle comprise a first handle member having a top end connecting to the connecting rod through a hinged connection; a second handle member integrally extended from the clip unit, wherein the first clip member and the second clip member are connected through a connecting arm of which one end of the connecting arm is fixed connected with the second handle member while the other end of the connecting arm is moveable connected with the first handle member such that a hinge point is formed at the fulcrum of the connecting arm and the first handle member for rotational movement while an upward movement of the connecting rod can actuate an upward movement of the lower clip plate The present invention can effectively solve the problems of non-existence of special wearing tool for magnetic false eyelashes and the time consuming and laborious problems of manual wearing. The magnetic false eyelashes members can be pre-loaded on corresponding positions on the upper plate and the lower plate of the wearing tool precisely. Then, the lower plate is moved upward so that the lower plate is moved closer to the upper plate and then the upper lash member and the lower lash member are accurately attracted to each other and positioned on both sides of the upper and lower sides of the real eyelashes. The present invention can wear the upper and lower lash members at one time while the angle of the upper plate can be adjusted when the magnetic false eyelashes are pre-loaded, thereby facilitating the loading of the upper lash member. Compared to traditional wearing method, the prevention invention has the characteristics of fastness, convenience, safety and precision.

Still further objects and advantages will become apparent from a consideration of the ensuing description and drawings. These and other objectives, features, and advantages of the present invention will become apparent from the following detailed description, the accompanying drawings, and the appended claims.

DETAILED DESCRIPTION OF THE PREFERRED EMBODIMENT

Figure 1:
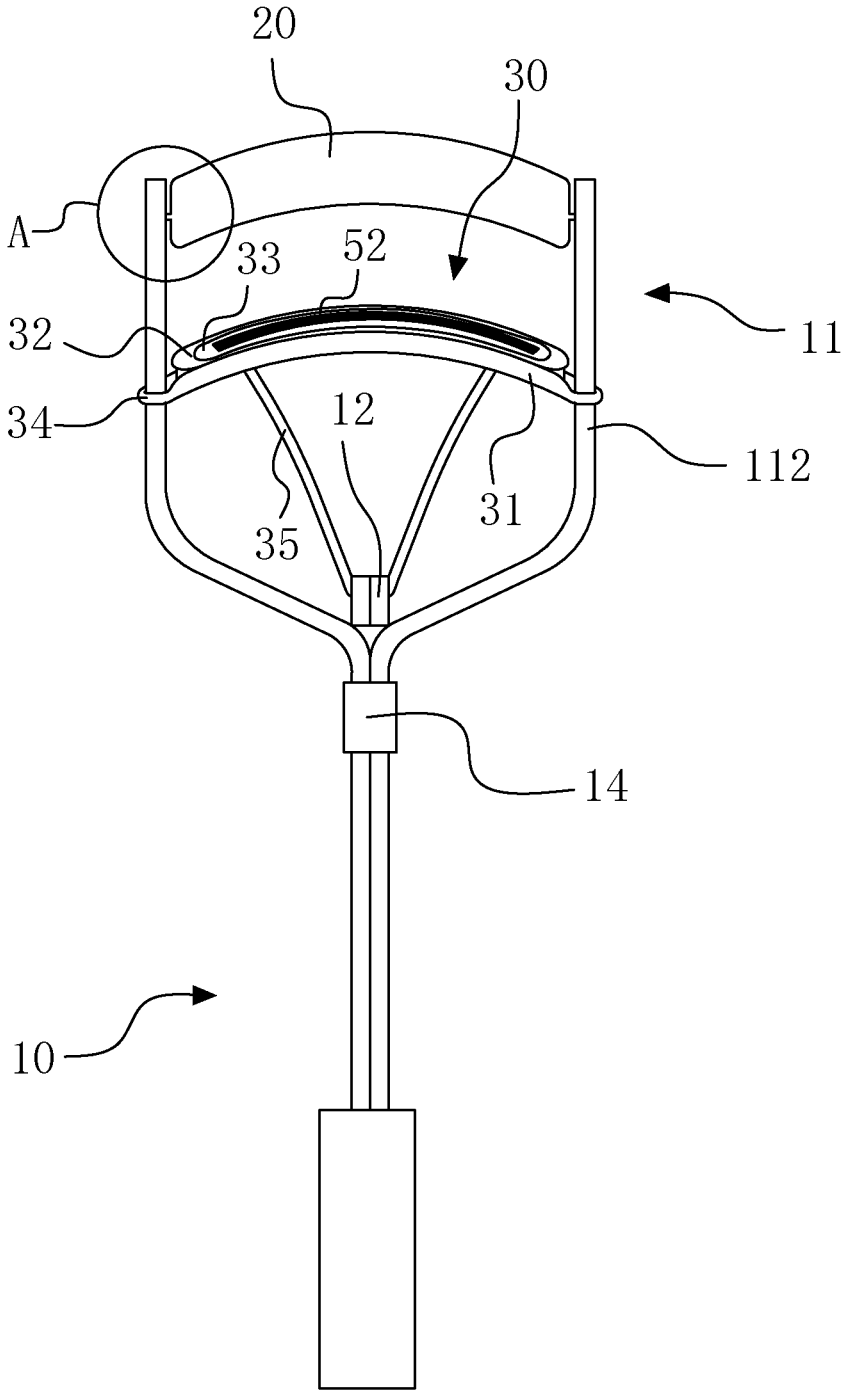
FIG. 1 is a plan view showing an overall structure of a quick wearing tool for magnetic eyelashes according to a preferred embodiment of the present invention.

The preferred embodiment of the present invention is further described with the accompanying drawings as follows, which is not intended to be limiting.

Referring to FIG. 1 to FIG. 8 of the drawings, the present invention provides a quick wearing tool for magnetic eyelashes comprises a handle 10, an upper clip plate 20, a lower clip plate 30, a magnetic eyelashes unit 40 and a position guiding member for magnetic eyelashes unit 50.

Figure 2:
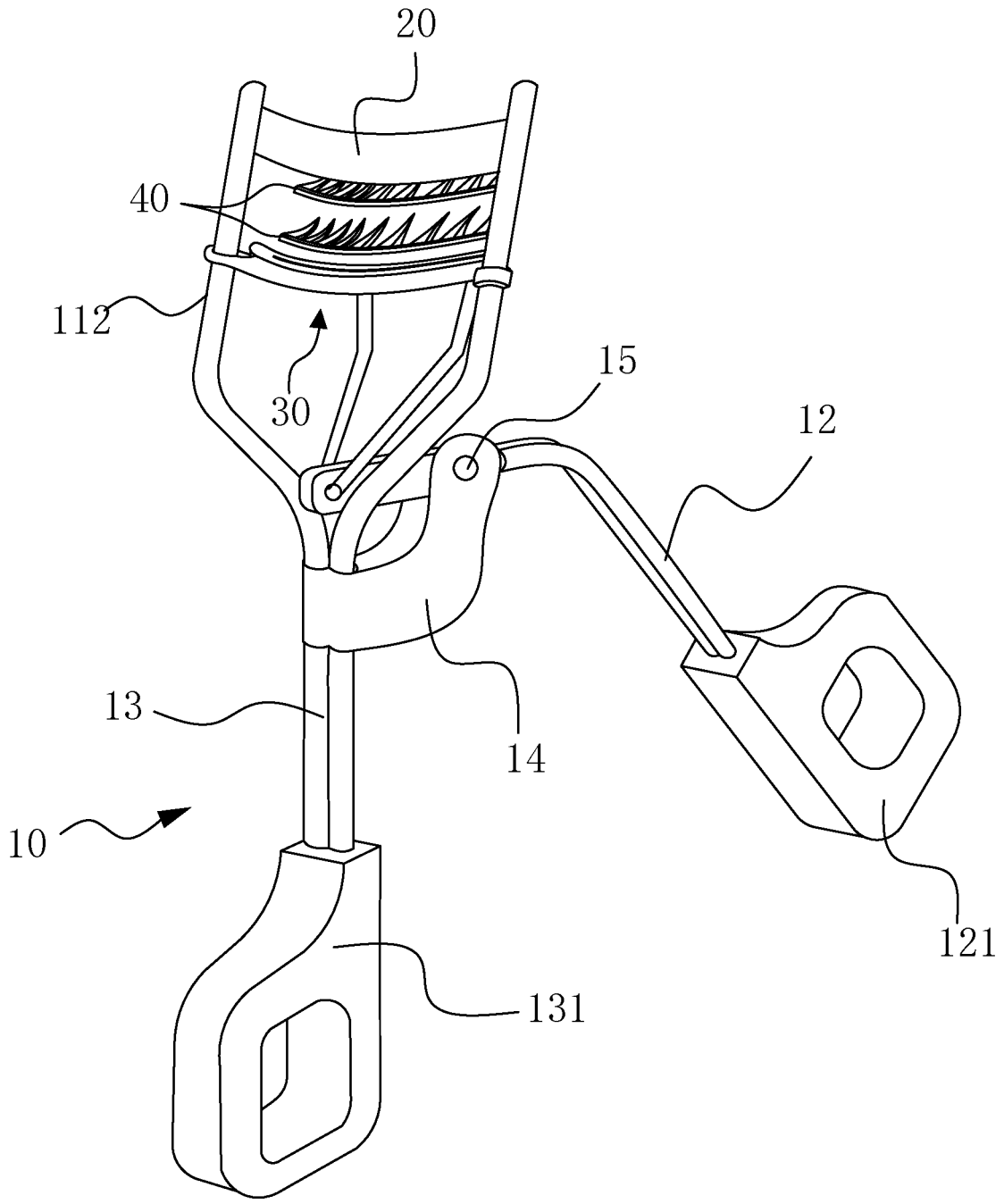
FIG. 2 is a perspective view illustration of a quick wearing tool for magnetic eyelashes according to the above preferred embodiment of the present invention.

Referring to FIG. 1 and FIG. 2 of the drawings, the handle 10 comprises a first handle member 12 and a second handle member 13. The first handle member 12 is a moveable handle having a top end connecting to a connecting rod 35 through a hinged connection. The connecting rod 35 has a top end fixedly connected to the lower clip plate 30. The first handle member 12 has a bottom end has a finger positioning member 121 arranged for guiding a position of a finger. The second handle member 13 is a stationary handle relative to the first handle member 12, and comprises a second finger positioning member 131 at its bottom end and a clip unit 11 integrally provided at its top end. The clip unit 11 has a U-shaped structure in which an open end of the letter "U" is facing upward. The clip unit 11 comprises two side rods 112 which are symmetrical to each other. The clip unit 11 can be made of hard and smooth materials such as plastic, metal, ceramic and the like. According to this embodiment, the clip unit 11 is made of stainless steel with a smooth surface. The clip unit 11 has a top end having two shaft holes 111. Specially, the two shaft holes 111 are provided at the inner side of the two side rods 112 respectively and are complementary to the pivot members 21 of the upper clip plate 20 for coupling such that the upper clip plate 20 is capable of rotating to a particular angle for easy installation when the magnetic eyelashes unit is loaded onto the upper clip plate 20. A connecting arm 14 is mounted between the first handle member 12 and the second handle member 13. The connecting arm 14 has a generally L-shaped structure having one end fixedly connected to the second handle member 13 and another end having a hinged connection with the first handle member 12 in such a manner that a hinge point 15 is formed at the fulcrum of the first handle member 12. When the first finger positioning member 121 of first handle member 12 pushes the first handle member 12 to rotate towards the second handle member 13 with the hinge point 15 as the fulcrum, the lower clip plate 30 is actuated through the connecting rod 35 which are hinged with the first handle member 12 to slide upward along the clip unit 11.

Figure 5:
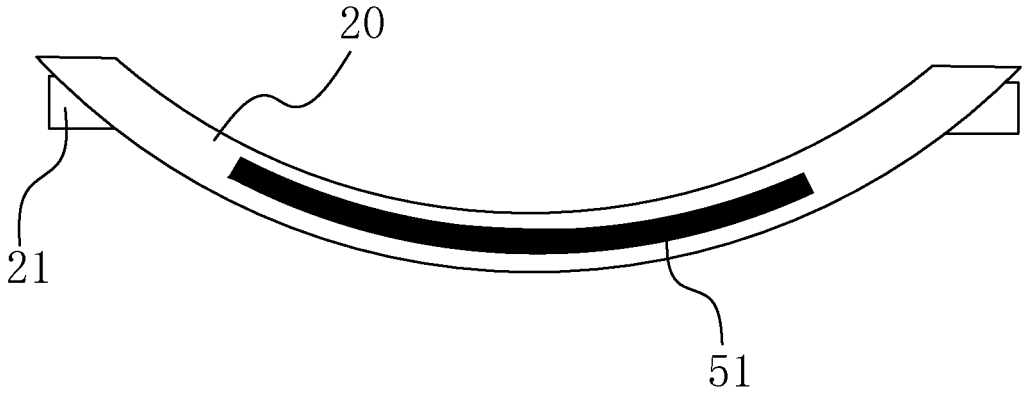
FIG. 5 is a bottom view of an upper clip plate of a quick wearing tool for magnetic eyelashes according to the above preferred embodiment of the present invention.

Referring to FIG. 1 and FIG. 5 of the drawings, the upper clip plate 20 can be made of iron materials, or made of magnetic materials having an opposite pole with respect to the magnetic pole of the magnetic eyelashes unit, or even made of magnetic materials, which forms a magnetic loop with the magnetic eyelashes unit. According to this embodiment, the upper clip plate 20 is made of magnetic materials having opposite pole with respect to the magnetic eyelashes unit and has a magnetic properties lower than that of the magnetic eyelashes unit so that the magnetic eyelashes unit can be separated from the upper clip plate 20 easily after wearing into position. The upper clip plate 20 has an arc-shaped sheet-like body corresponding to the shape of a human eyelid. The upper clip plate 20 has a L-shaped edge portion 22 at its bottom end which is outwardly extended from its bottom end. The edge portion 22 is positioned corresponding to a position of the flexible stripe 32 of the lower clip plate 30 and the surface of the edge portion 22 which is facing the flexible stripe 32 forms the loading surface of the magnetic eyelashes unit 40. The upper clip plate 20 and the lower clip plate 30 comprises a position guiding member for magnetic eyelashes unit 50, which has a color indication at the loading position of magnetic eyelashes unit. When loading the magnetic eyelashes unit 40, the magnetic eyelashes unit 40 can be loaded quickly to the upper clip plate 20 and the lower clip plate 30 according to the position guiding member for magnetic eyelashes unit 50. The upper clip plate 20 comprises pivot members 21 integrally formed at two ends of the upper clip plate 20 respectively. The two pivot members 21 is rotatably connected to the two shaft holes 111 of the clip unit 11 such as the upper clip plate 20 can be rotated to facilitate the angle for phase adsorption with a magnetic eyelashes member 41 of the magnetic eyelashes unit 40.

Figure 6:
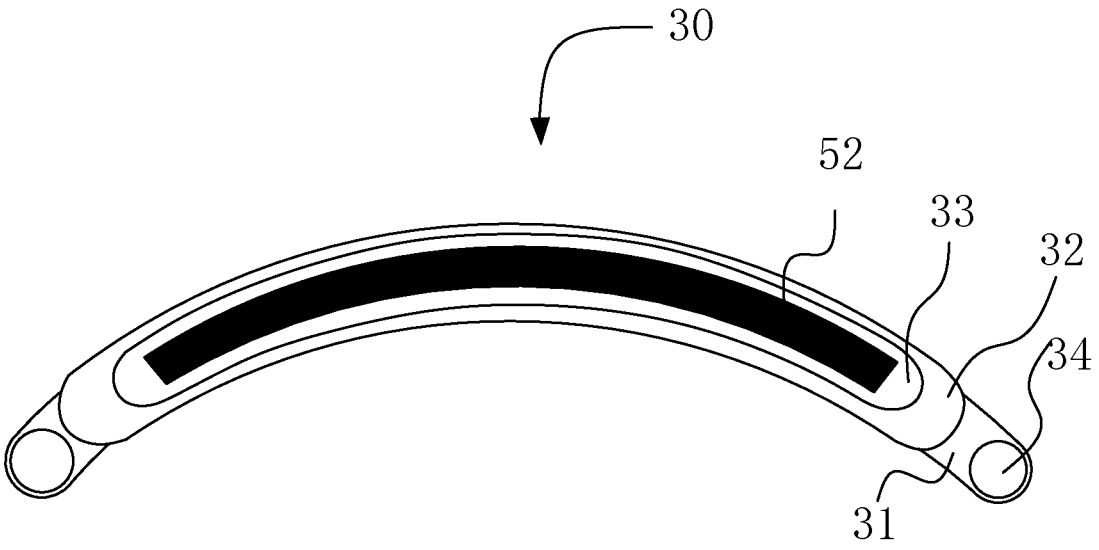
FIG. 6 is a top view of a lower clip plate of a quick wearing tool for magnetic eyelashes according to the above preferred embodiment of the present invention.

Referring to FIG. 1 and FIG. 6 of the drawings, the lower clip plate 30 comprises a curved clip body 31, a flexible stripe 32 covered on the curved clip body 31 and a conductive adhesive coated on the flexible stripe 32 which has a magnetic property lower than that of the magnetic eyelashes unit 40. The curved clip body 31 can be made of hard and smooth materials such as plastic, metal, ceramic and the like. According to this embodiment, the curved clip body 31 is made of stainless steel with a smooth surface. The curved clip body 31 has a position corresponding to the L-shaped edge portion 22 of the upper clip plate 30. The curved clip body 31 has two ring connection sleeves 34 at two side ends for coupling with the clip unit 11 in such a manner that the lower clip plate 30 can slide upwardly and downwardly along the clip unit 11. The flexible stripe 32 can be made of plastic, rubber or silicone. According to this preferred embodiment, the flexible stripe 32 is made of silicone, has a curved cross-section and a smooth arc surface at its upper surface. The flexible stripe 32 has a bottom end embedded into the curved clip body 31. The upper surface of the flexible stripe 32 is a smooth curved surface, therefore a protection effect to the eyelids is provided when wearing the magnetic eyelashes unit 40. The conductive adhesive 33 on top of the flexible stripe 32 can form a magnetic loop with the lower magnetic eyelashes member 42 so that the lower magnetic eyelashes member 42 is adsorbed thereon.

Figure 7:
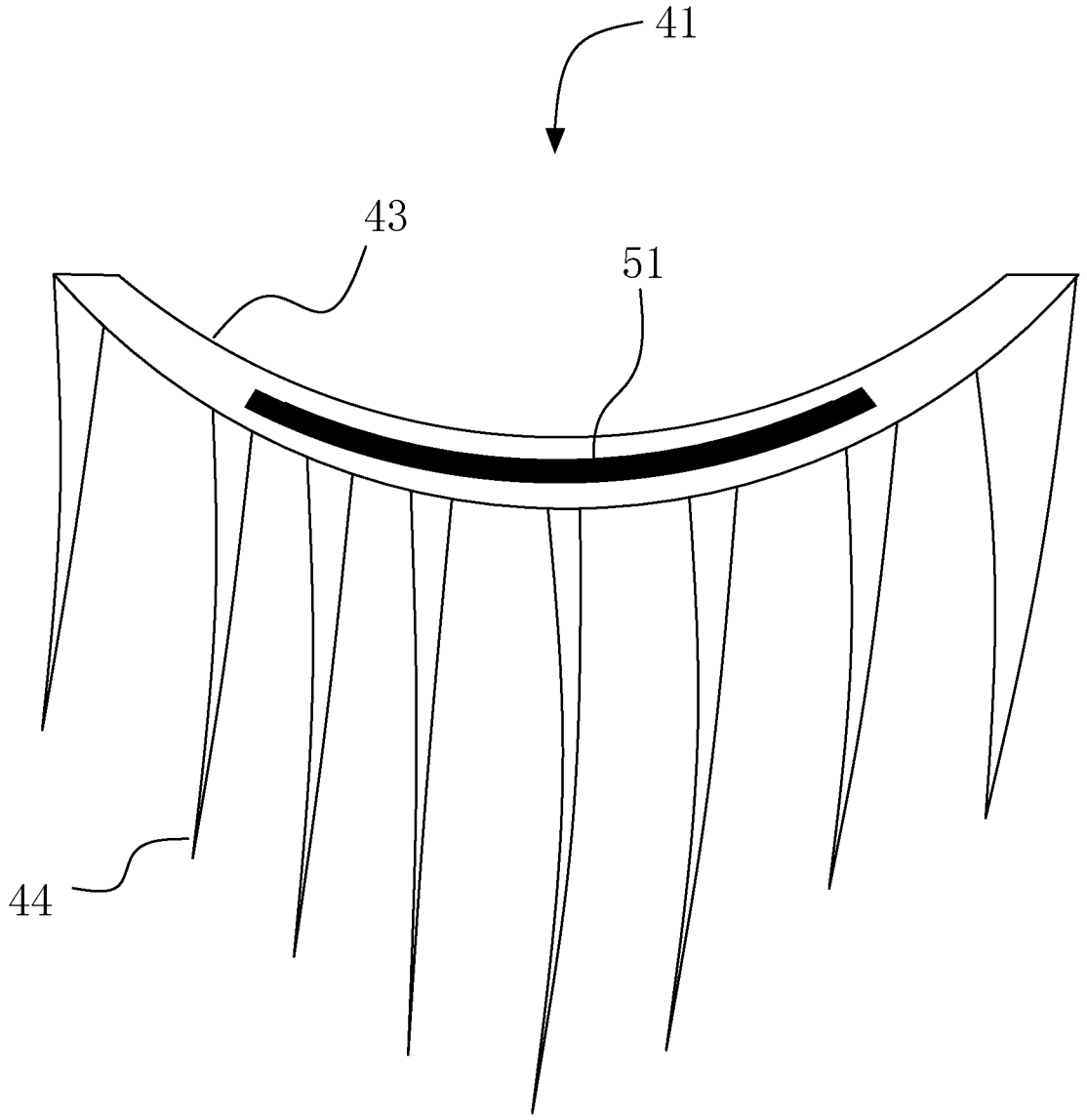
FIG. 7 is a top view of an upper magnetic eyelashes member according to a preferred embodiment of the present invention.
Figure 8:
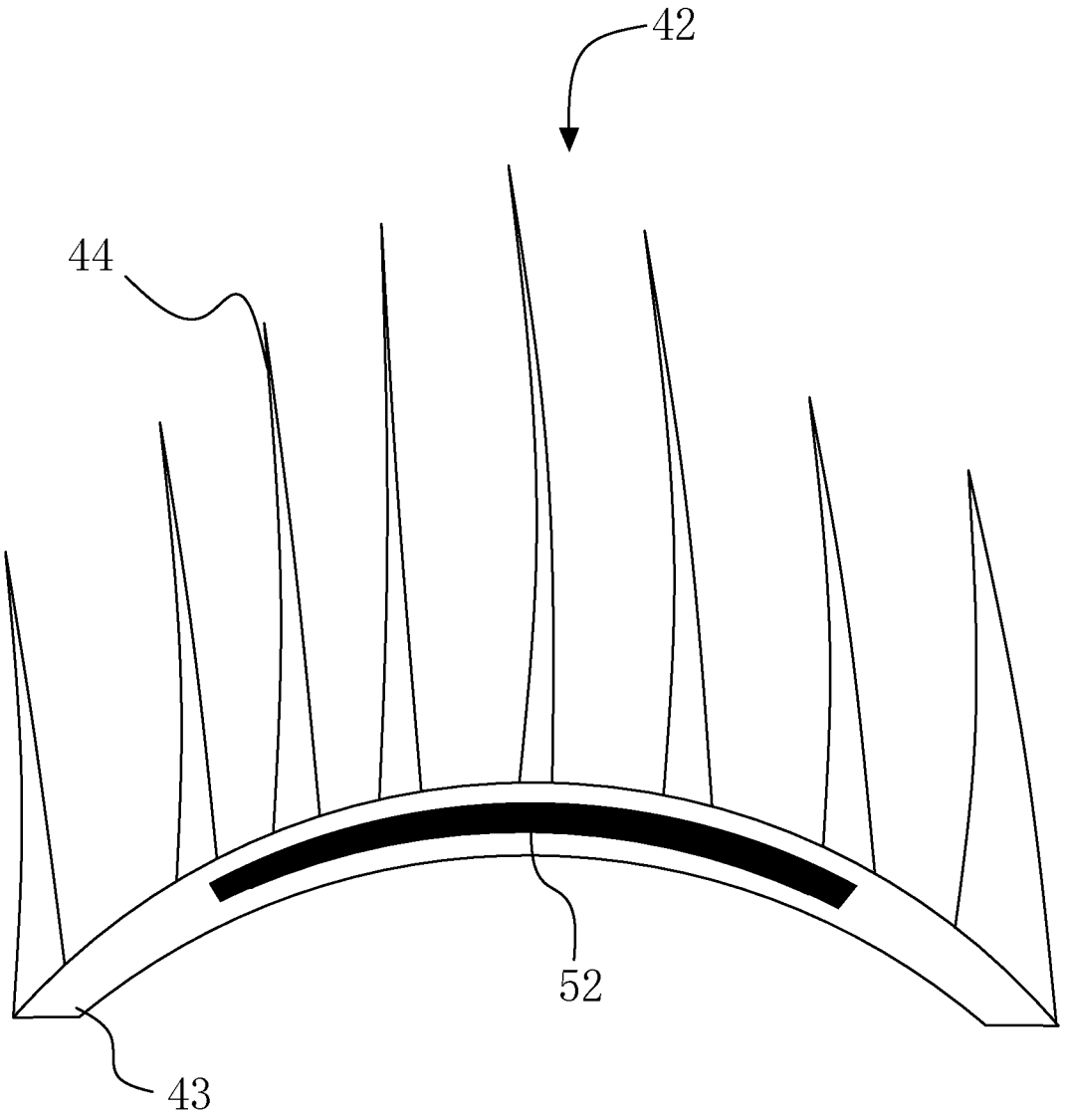
FIG. 8 is a bottom view of a lower magnetic eyelashes member according to a preferred embodiment of the present invention.

Referring to FIG. 7 and FIG. 8 of the drawings, the magnetic eyelashes unit 40 is eyelashes members which are adsorbed through magnetic attraction. The magnetic eyelashes unit 40 comprises an upper member and a lower member and the two members are magnetically opposite to each other. The magnetic eyelashes unit 40 comprises a plurality of false eyelashes fixed on a thin magnetic film or stripe. The magnetic eyelashes unit 40 comprises an upper magnetic eyelashes member 41 and a lower magnetic eyelashes member 42. Each of the upper magnetic eyelashes member 41 and the lower magnetic eyelashes member 42 comprises a sheet-like magnetic stripe and a plurality of false eyelashes 44 affixed on the sheet-like magnetic stripe. The sheet-like magnetic stripes of the upper magnetic eyelashes member 41 and the lower magnetic eyelashes member 42 are magnetically opposite to each other. Preferably, the sheet-like magnetic stripes is flexible in nature and are corresponding to the curve lines of eyelids of human. When the upper magnetic eyelashes member 41 and the lower magnetic eyelashes member 42 are worn onto the two sides of the true eyelashes through the wearing tool of the present invention, the two magnetic stripes which has opposite polarity are attracted to each other and secured into position.

According to FIG. 5 and FIG. 6 of the present invention, in order to facilitate positioning and wearing of the magnetic eyelashes unit, a position guiding member for magnetic eyelashes unit 50 is provided on the upper clip plate 20 and the lower clip plate 30. According to the preferred embodiment, the position guiding member for magnetic eyelashes unit 50 is a color indicator. The position guiding member for magnetic eyelashes unit 50 on the upper clip plate 20 and on the lower clip plate 30 have a position with are corresponding to each other. The position guiding member for magnetic eyelashes unit 50 comprises a yellow indicator printed on the edge portion 22 of the upper clip plate 20 and a red indicator printed on the conductive adhesive 33 of the lower clip plate 30. The yellow indicator 51 and the red indicator 52 are corresponding stripe-shaped sections so that the magnetic eyelashes unit 40 can be pre-loaded precisely onto the position guiding member for magnetic eyelashes unit 50 of the upper clip plate 20 and the lower clip plate 30.

Figure 3:
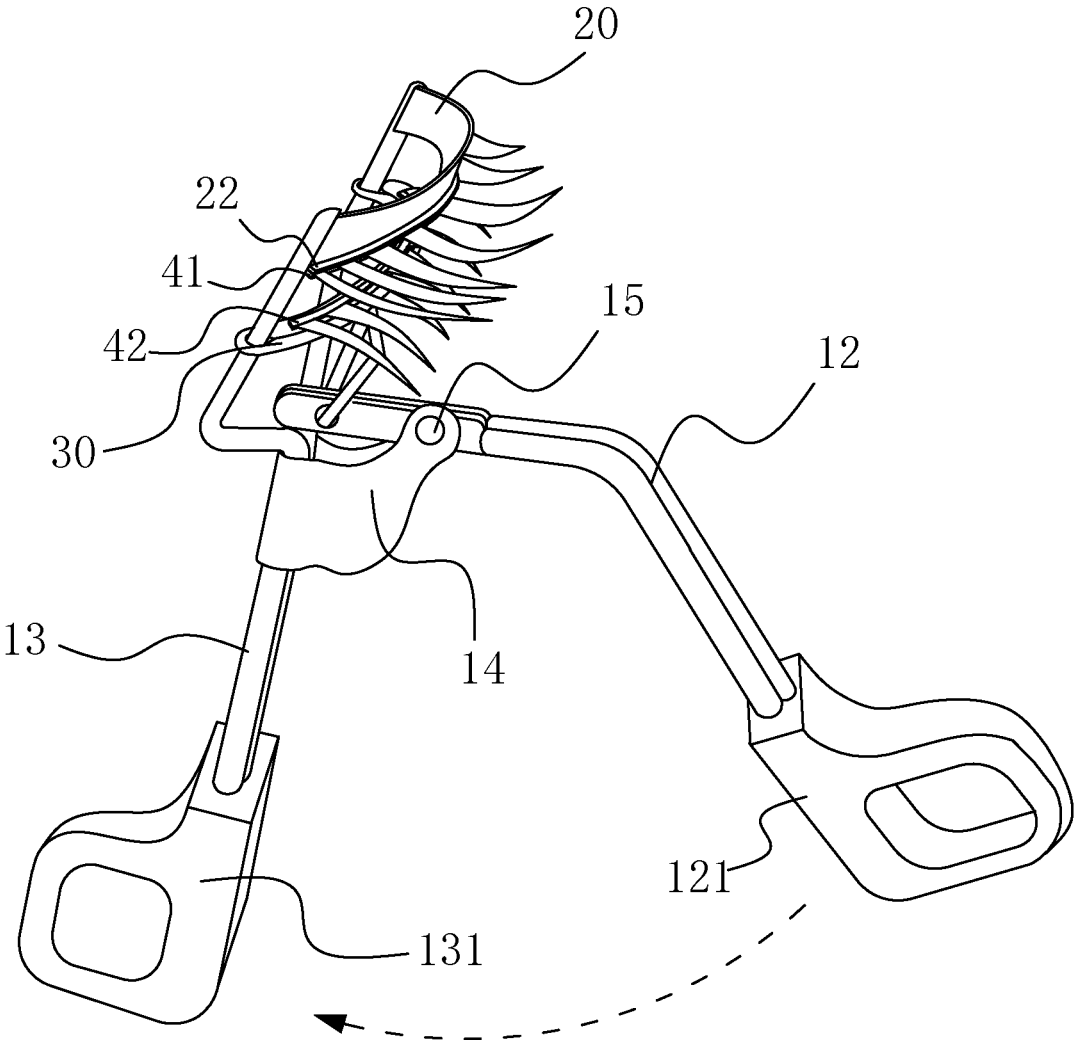
FIG. 3 is a schematic view, showing the use of a quick wearing tool for magnetic eyelashes according to the above preferred embodiment of the present invention.
Figure 4:
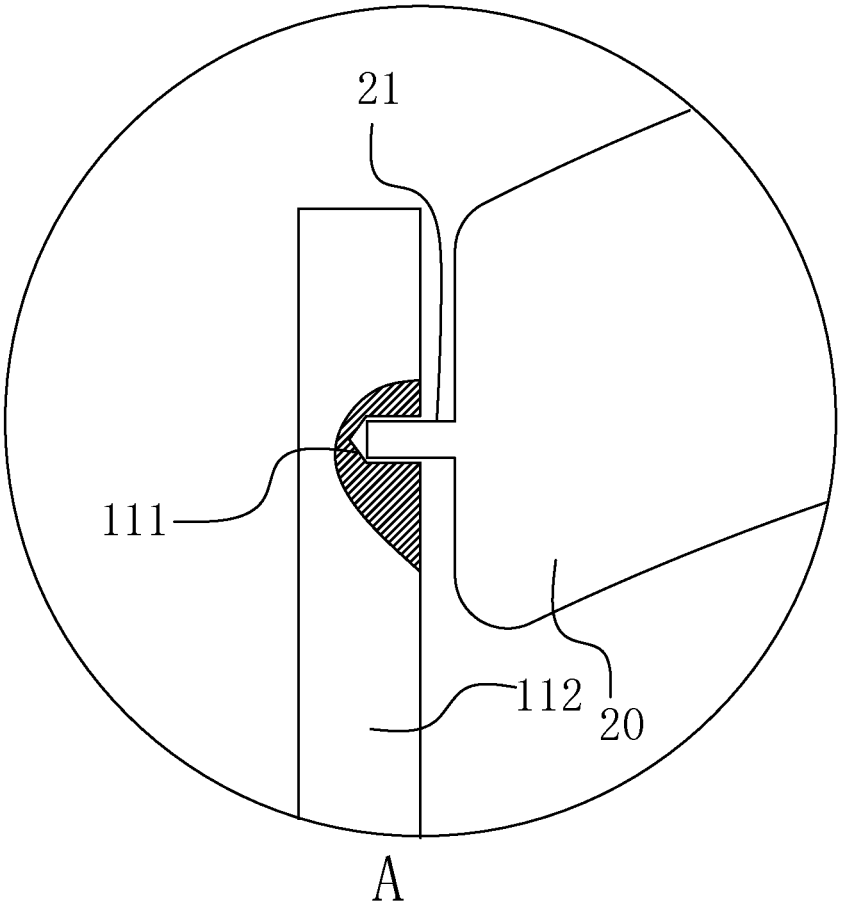
FIG. 4 is a schematic view, showing a connection structure between an upper clip plate and a clip unit according to the above preferred embodiment of the present invention.

The working principle of the present invention is shown in FIG. 2 and FIG. 3 of the drawings. First, the upper magnetic eyelashes member 41 is loaded onto the upper clip plate 20. When loading, the upper clip plate 20 is rotated 180° in a clockwise direction so that the yellow indicator 51 of the edge portion 22 is faced upright. The sheet-like magnetic stripe or iron-based film 43 of the upper magnetic eyelashes member 41 is aligned with the yellow indicator 51 and are absorbed onto the upper clip plate 20 precisely through magnetic attraction. The false eyelashes 44 of the upper magnetic eyelashes member 41 face towards the direction of the position of the second handle member 13. Then, the sheet-like magnetic stripe or iron-based film 43 of the lower magnetic eyelashes member 42 is aligned with the red indicator 51 and are absorbed onto the lower clip plate 30 precisely through magnetic attraction. The false eyelashes 44 of the lower magnetic eyelashes member 42 face towards the direction of the position of the first handle member 12. Then, the upper clip plate 20 is rotated 180° in an anticlockwise direction so that the false eyelashes 44 of the magnetic eyelashes unit 40 are unified to face towards the direction of the position of the first handle member 12. The next step is wearing the upper magnetic eyelashes member 41 and the lower magnetic eyelashes member 42 onto the two sides of real eyelashes of a human eye. When wearing, fingers are inserted into the first and the second finger positioning member 121, 131. The first handle member 12 and the connecting rod 35 are urged to rotate clockwise about the hinge point 15. The lower clip plate 30 is moved upwardly along the side rods 112 of the clip unit 11 by the actuation of the connecting rod 35 and the action of the ring connection sleeves 34 which is engaged with the side rods 112 of the clip unit 11. At this moment, the magnetic properties of the upper clip plate 20 and the lower clip plate 30 are lower than that of the magnetic eyelashes unit 40 such that when the upper clip plate 20 is close to the lower clip plate 30, the upper magnetic eyelashes member 41 and the lower magnetic eyelashes member 42 are engaged to each other magnetically at two sides of the real eyelashes of the eye of human. After wearing, the handle 10 is released.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A quick wearing tool for a magnetic eyelashes unit which comprises an upper magnetic eyelashes member and a lower magnetic eyelashes member, comprising:

a handle;

a clip unit integrally provided at a top end of said handle;

an upper clip plate connected to a top end of said clip unit; and a lower clip plate moveable connected to said handle in such a manner that said lower clip plate is capable of moving upwardly and downwardly;

wherein said upper clip plate and said lower clip plate are having a magnetic polarity and said magnetic polarity of said upper clip plate and said lower clip plate are arranged to be opposite to the magnetic eyelashes members respectively or are arranged to form a magnetic loop with the magnetic eyelashes members, wherein magnetic properties of said upper clip plate and said lower clip plate are lower than that of the magnetic eyelashes members such that the magnetic eyelashes members are capable of loading onto said upper clip plate and said lower clip plate respectively through magnetic attraction, and then the magnetic eyelashes members are capable of being detached from said upper clip plate and said lower clip plate respectively to secure into position on real eyelashes by magnetic attraction between the upper eyelashes member and the lower eyelashes member when said lower clip plate is moved upward towards said upper clip plate, thereby real eyelashes are sandwiched by the upper eyelashes member and the lower eyelashes member.

2. The quick wearing tool for a magnetic eyelashes unit according to claim 1, wherein said upper clip plate has an arc-shaped sheet body corresponding to a shape of an upper eyelid of a human and is made of magnetic or iron materials, wherein all corners of said upper clip plate are flattened into smooth edges.

3. The quick wearing tool for a magnetic eyelashes unit according to claim 2, wherein said upper clip plate is rotatably connected to said clip unit at a top end of said clip unit so that a rotational angle of said upper clip plate is adjustable to fit an angle of the loading of magnetic eyelashes unit.

4. The quick wearing tool for a magnetic eyelashes unit according to claim 3, wherein said clip unit has two shaft holes and said upper clip plate has two pivot members integrally extended from two side ends of said upper clip plate, wherein said two pivot members and said two shaft holes are coupled together respectively so that said upper clip plate is moveably connected to said clip unit through said shaft holes.

5. The quick wearing tool for a magnetic eyelashes unit according to claim 1, wherein said clip unit comprises two symmetric side rods and defines a U-shaped structure of said clip unit in which top open portions are formed through said two side rods while bottom portions of said two side rods are bended inward to connect together, wherein said bottom portions of said two side rods are connected to said handle.

6. The quick wearing tool for a magnetic eyelashes unit according to claim 1, wherein said lower clip plate comprises a curved clip body which is corresponding to a shape of human eyelid, a flexible stripe having a curved surface on top of said curved clip body, and a conductive adhesive coated onto the surface of said flexible stripe, wherein said conductive adhesive has a magnetic property which is arranged for forming a magnetic loop with the magnetic eyelashes unit, wherein said curved clip body has two ring connection sleeves at two side ends integrally provided on said curved clip body and said two ring connection sleeves are moveable connected to said two side rods of said clip unit such that said curved clip body is capable of sliding upward and downward, wherein said curved clip body is hinged to said handle through a connecting rod.

7. The quick wearing tool for a magnetic eyelashes unit according to claim 6 wherein said upper clip plate has a L-shaped edge portion at a bottom thereof which is outwardly extended from said bottom of said upper clip plate, and has a position corresponding to a position of said flexible stripe, wherein said upper clip plate and said lower clip plate comprise a color indicator.

8. The quick wearing tool for a magnetic eyelashes unit according claim 6, wherein said handle comprise a first handle member having a top end connecting to said connecting rod through a hinged connection; a second handle member integrally extended from said clip unit, wherein said first clip member and said second clip member are connected through a connecting arm of which one end of said connecting arm is fixedly connected with said second handle member while the other end of said connecting arm is movably connected with said first handle member, wherein a hinge point is formed at a fulcrum of said connecting arm and said first handle member for rotational movement while an upward movement of said connecting rod can actuate an upward movement of said lower clip plate.

9. The quick wearing tool for a magnetic eyelashes unit according to claim 1 wherein said upper clip plate has a L-shaped edge portion at a bottom thereof which is outwardly extended from said bottom of said upper clip plate, and has a position corresponding to a position of a flexible stripe, wherein said upper clip plate and said lower clip plate comprise a color indicator.

10. The quick wearing tool for a magnetic eyelashes unit according claim 1, wherein said handle comprise a first handle member having a top end connecting to a connecting rod through a hinged connection; a second handle member integrally extended from said clip unit, wherein said first clip member and said second clip member are connected through a connecting arm of which one end of said connecting arm is fixedly connected with said second handle member while the other end of said connecting arm is movably connected with said first handle member, wherein a hinge point is formed at a fulcrum of said connecting arm and said first handle member for rotational movement while an upward movement of said connecting rod can actuate an upward movement of said lower clip plate.

11. A quick wearing tool for a pair of magnetic eyelashes members having opposite magnetic polarity, comprising:

a handle;

a clip unit integrally provided at a top end of said handle;

an upper clip plate connected to a top end of said clip unit; and a lower clip plate moveable connected to said handle allowing upward and downward movement of said lower clip plate; wherein said upper clip plate and said lower clip plate are having a magnetic polarity which are opposite to each other for having the magnetic polarity opposite to the pair of magnetic eyelashes members respectively while the magnetic properties of said upper clip plate and said lower clip plate are arranged to be lower than that of the magnetic eyelashes members, thereby said magnetic eyelashes members are attached onto said upper clip plate and said lower clip plate respectively and then are arranged to detach from said upper clip plate and said lower clip plate to attract together to secure into position on real eyelashes when said lower clip plate is moved upward towards said upper clip plate.

12. The quick wearing tool according to claim 11, wherein said clip unit comprises two symmetric side rods, each of said side rods has a top end defining a free end and a bottom end which is bended towards the other side rod so as to connect to said other side rod, said handle is connected to the said two side rods through said bottom end, wherein a shaft hole is provide at a stop end of each said side rod and said upper clip plate has two pivot members integrally extended from two side ends of said upper clip plate, wherein said two pivot members and said two shaft holes are coupled together respectively so that said upper clip plate is moveably connected to said clip unit through said shaft holes and is capable of rotational movement.

13. The quick wearing tool according to claim 12, wherein said lower clip plate comprises a curved clip body which is corresponding to a shape of human eyelid, a flexible stripe having a curved surface on top of said curved clip body, and a conductive adhesive coated onto the surface of said flexible stripe, wherein said conductive adhesive has a magnetic property and the magnetic property of said conductive adhesive is arranged to be lower than that of the magnetic eyelashes members, wherein said curved clip body has two ring connection sleeves at two side ends integrally provided on said curved clip body and said two ring connection sleeves are movably connected to said two side rods of said clip unit such that said curved clip body is capable of sliding upward and downward, wherein said curved clip body is hinged to said handle through a connecting rod.

14. The quick wearing tool according to claim 13, wherein said upper clip plate has a L-shaped edge portion at a bottom thereof which is outwardly extended from said bottom of said upper clip plate, and has a position corresponding to a position of said flexible stripe, wherein each of said upper clip plate and said lower clip plate comprise a color indicator for guiding a positioning of the magnetic eyelashes members, wherein said handle comprises a first handle member having a top end connecting to a connecting rod through a hinged connection; a second handle member integrally extended from said clip unit, wherein said first clip member and said second clip member are connected through a connecting arm of which one end of said connecting arm is fixedly connected with said second handle member while the other end of said connecting arm is movably connected with said first handle member such that a hinge point is formed at a fulcrum of said connecting arm and said first handle member for rotational movement while an upward movement of said connecting rod can actuate an upward movement of said lower clip plate.

15. A magnetic eyelashes kit, comprising a pair of magnetic eyelashes members having opposite magnetic polarity; and a quick wearing tool, wherein said quick wearing tool comprises:

a handle;

a clip unit integrally provided at a top end of said handle;

an upper clip plate connected to a top end of said clip unit; and a lower clip plate movably connected to said handle allowing upward and downward movement of said lower clip plate;

wherein said upper clip plate and said lower clip plate are having a magnetic polarity opposite to the pair of magnetic eyelashes members respectively while the magnetic properties of said upper clip plate and said lower clip plate are lower than that of the magnetic eyelashes members, thereby said magnetic eyelashes members are attached onto said upper clip plate and said lower clip plate respectively and then are arranged to detach from said upper clip plate and said lower clip plate to attract together to secure into position on real eyelashes when said lower clip plate is moved upward towards said upper clip plate.

16. The magnetic eyelashes kit according to claim 15, wherein said magnetic eyelashes member comprises a magnetic body consisting of a thin magnetic stripe or an iron film; and a plurality of eyelashes affixed on said magnetic body.

17. The magnetic eyelashes kit according to claim 16, wherein said clip unit comprises two symmetric side rods, each of said side rods has a top end defining a free end and a bottom end which is bended towards the other side rod so as to connect to said other side rod, said handle is connected to the said two side rods through said bottom end, wherein a shaft hole is provide at a stop end of each said side rod and said upper clip plate has two pivot members integrally extended from two side ends of said upper clip plate, wherein said two pivot members and said two shaft holes are coupled together respectively so that said upper clip plate is moveably connected to said clip unit through said shaft holes and is capable of rotational movement.

18. The magnetic eyelashes kit according to claim 17, wherein said lower clip plate comprises a curved clip body which is corresponding to a shape of human eyelid, a flexible stripe having a curved surface on top of said curved clip body, and a conductive adhesive coated onto the surface of said flexible stripe, wherein said conductive adhesive has a magnetic property lower than that of the magnetic eyelashes members, wherein said curved clip body has two ring connection sleeves at two side ends integrally provided on said curved clip body and said two ring connection sleeves are movably connected to said two side rods of said clip unit such that said curved clip body is capable of sliding upward and downward, wherein said curved clip body is hinged to said handle through a connecting rod.

19. The magnetic eyelashes kit according to claim 18, wherein said upper clip plate has a L-shaped edge portion at a bottom thereof which is outwardly extended from said bottom of said upper clip plate, and has a position corresponding to a position of said flexible stripe, wherein each of said upper clip plate and said lower clip plate comprises a color indicator for guiding a positioning of the magnetic eyelashes members, wherein said handle comprise a first handle member having a top end connecting to said connecting rod through a hinged connection; a second handle member integrally extended from said clip unit, wherein said first clip member and said second clip member are connected through a connecting arm of which one end of said connecting arm is fixedly connected with said second handle member while the other end of said connecting arm is movably connected with said first handle member such that a hinge point is formed at a fulcrum of said connecting arm and said first handle member for rotational movement while an upward movement of a connecting rod can actuate an upward movement of said lower clip plate.

* * * * *